United States Patent [19]

Misercola

[11] 4,076,032

[45] * Feb. 28, 1978

[54] VENTED HAIR BRUSH

[75] Inventor: Douglas Misercola, Mamaroneck, N.Y.

[73] Assignee: Empire Brushes, Inc., Port Chester, N.Y.

[ * ] Notice: The portion of the term of this patent subsequent to Dec. 21, 1990, has been disclaimed.

[21] Appl. No.: 715,187

[22] Filed: Aug. 17, 1976

[51] Int. Cl.[2] ..... A45D 20/00

[52] U.S. Cl. ..... 132/9; 15/160; 34/97; D4/31

[58] Field of Search ..... 15/182, 183, 186–188, 15/159, 160; 132/7, 9, 11 R, 33 R, 85, 120, 121; 34/96, 97; 401/286–288, 291; D4/31

[56] References Cited

U.S. PATENT DOCUMENTS

| | | | |
|---|---|---|---|
| D. 127,983 | 7/1941 | Wechsler | 15/143 R |
| D. 242,750 | 12/1976 | Misercola | D4/31 |
| 1,375,755 | 4/1921 | Hastings | 300/21 |
| 3,010,131 | 11/1961 | Kisky | 15/167 R |
| 3,868,495 | 2/1975 | Dyer | 34/97 |
| 3,903,905 | 9/1975 | Tucker | 132/9 |
| 3,911,934 | 10/1975 | Helbling | 132/9 |
| 3,949,765 | 4/1976 | Vallis | 132/11 R |
| 3,981,314 | 9/1976 | Barradas | 34/97 |

FOREIGN PATENT DOCUMENTS

| | | | |
|---|---|---|---|
| 2,348,419 | 4/1974 | Germany | 132/9 |
| 2,535,421 | 3/1976 | Germany | 132/9 |
| 24,663 | 10/1912 | United Kingdom | 34/97 |

*Primary Examiner*—Peter Feldman
*Attorney, Agent, or Firm*—J. B. Felshin

[57] ABSTRACT

This is a hair brush for use with blow styling dryers. It comprises a handle from which there extends, in alignment with the handle, a tubular brush block formed with many air slots between radial tufts of brush bristles, so that air blown from a hot air styling dryer can be directed against the brush as the hair is brushed or as locks of hair are wound around the brush block to quickly style the hair. The axial hole the brush block is open at its outer end. The handle is not round so that it can be more easily gripped and rotated to wind hair therearound.

22 Claims, 6 Drawing Figures

VENTED HAIR BRUSH

This invention relates to hair brushes. An object of this invention is to provide a highly improved hair brush that makes hair styling easy and can be used with use of a blow styling air dryer.

Another object of this invention is to provide a hair brush of the character described comprising a tubular brush block provided with a plurality of spaced radiating tufts of brush bristles disposed longitudinally of the block and all around the block, said block being formed with slots between the tufts so that air can be blown through the slots and central hole in the block as the hair is brushed or as hair is wound around the block to quickly dry the hair as it is being brushed or curled.

Still another object of this invention is to provide a hair brush of the character described in which the tubular brush block extends axially from a handle and in which the axial hole in the tubular brush block is open at its end, and in which the slots are so designed as to permit ready flow of air transversely through the block, yet the block being strong and rigid and not easily broken, and said block being so designed furthermore as to be readily molded.

Yet another object of this invention is to provide a hair brush of the character described in which the handle is non-circular and so shaped as to be firmly gripped and easily rotated to facilitate brushing or curling the hair as it is being dryed.

A further object of this invention is to provide a strong, rugged, durable, and yet light weight hair brush of the character described which allows hot air to flow through the brush, which makes hair styling quicker and easier, which shall be inexpensive to manufacture, easy to use and which shall yet be practical and efficient to a high degree in use.

Other objects of this invention will in part be obvious and in part hereinafter pointed out.

The invention accordingly consists in the features of construction, combinations of elements, and arrangement of parts which will be exemplified in the construction hereinafter described and of which the scope of the invention will be indicated in the following claims:

IN THE DRAWINGS

Figure 3:
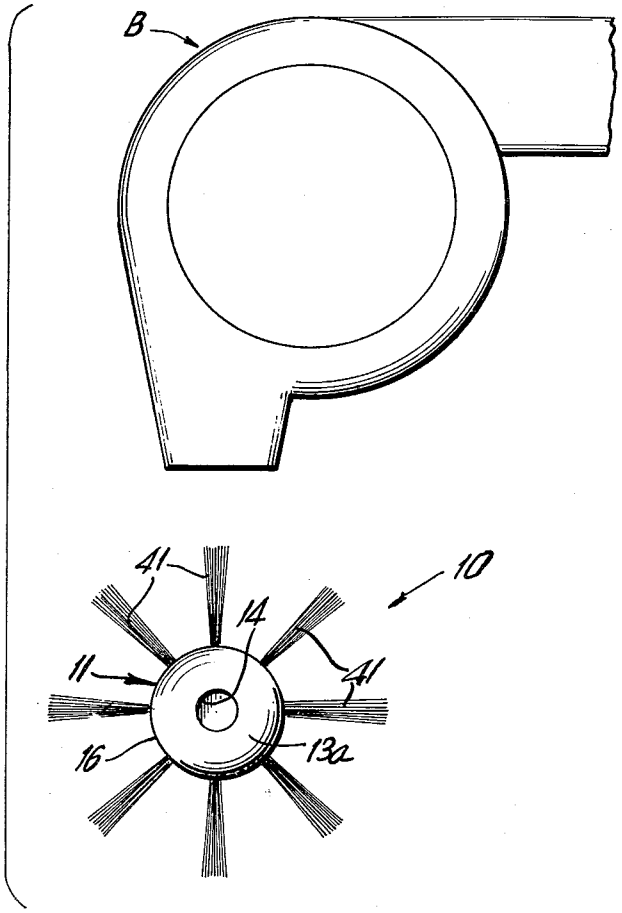
FIG. 3 is an end view of the brush of FIG. 1 looking at the outer end of the brush block.
Figure 1:
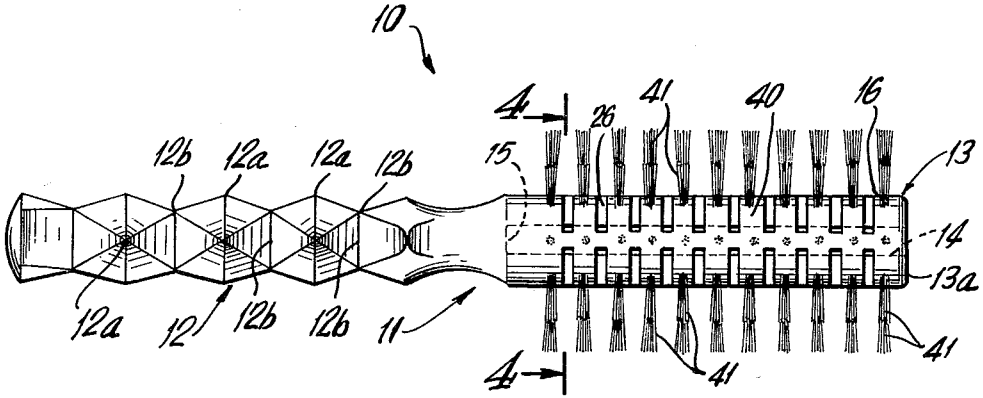
FIG. 1 is a side view of a hair brush embodying the invention.
Figure 2:
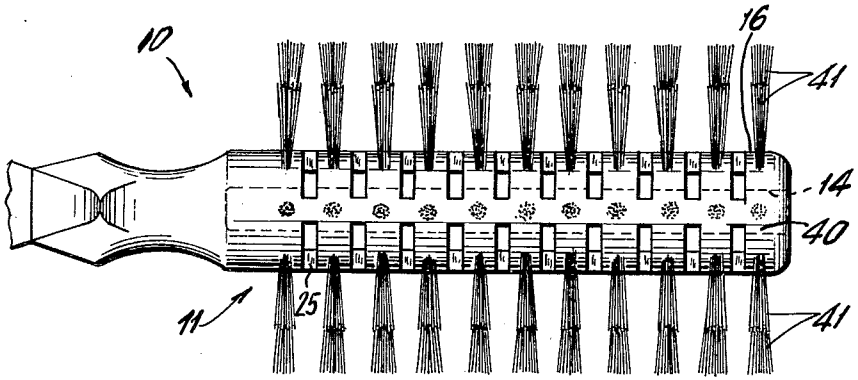
FIG. 2 is a partial view like FIG. 1 but looking at the brush from a direction turned 90° from the FIG. 1 position.

Referring now in detail to the drawing, 10 designates a hair brush embodying the invention. Said brush 10 comprises a molded plastic body 11 having a straight handle 12 from one end of which extends a brush block 13 coaxial with the handle. The brush block 13 has an axial cylindrical bore 14 and is open at its outer end which is located at the outer end 13*a* of the block. The bore 14 terminates at 15 adjacent the handle 12. The block 13 has an outer cylindrical surface 16.

Figure 4:
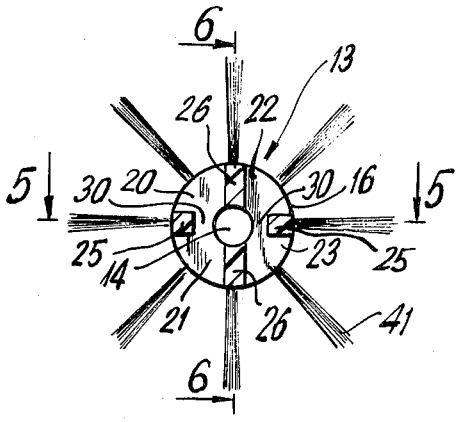
FIG. 4 is a cross-sectional view taken on line 4—4 of FIG. 1.
Figure 5:
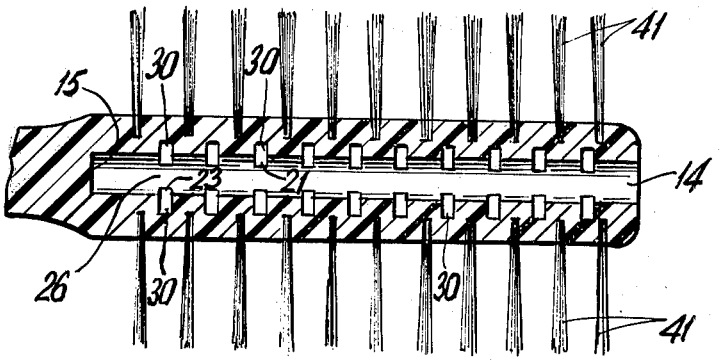
FIG. 5 is a cross-sectional view taken in line 5—5 of FIG. 4.
Figure 6:
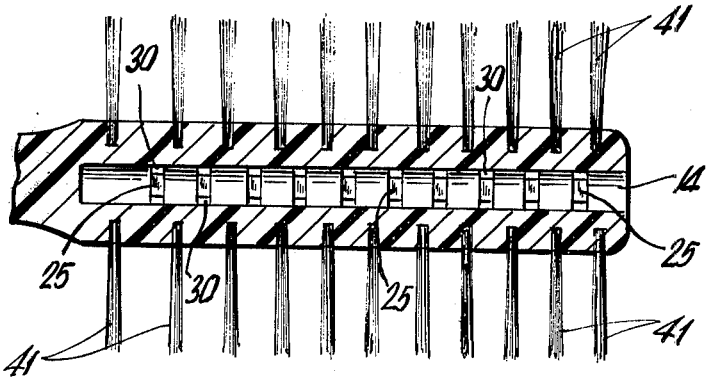
FIG. 6 is a cross-sectional view taken on line 6—6 of FIG. 4.

Said block 13 is formed with a plurality of equally longitudinally spaced sets of passages or slots, ten such sets being shown in the drawing for purpose of illustration. The number of sets of slots may be varied. In each set there are four slots extending from the outer surface 16 to the bore 14. The slots in each set of slots are numbered 20, 21, 22, 23 as shown in FIG. 4. Between slots 20, 21 and between slots 22, 23 of each set of slots are a pair of diametric webs 25. Between slots 20 and 22 and between slots 21 and 23 of each set of slots are a pair of diametric webs 26. In FIG. 4, webs 25 are shown horizontally aligned and webs 26 vertically aligned.

It will be noted that webs 25 extend radially inwardly from the outer surface 16 but terminate short of the bore 14 whereas webs 26 extend from the outer surface 16 to the bore 14.

Thus webs 26, being longer provide 1, strength to the core against breakage. The shorter webs 25 allow slots 20 and 21 to be directly in communication, so that when a blower B blows air downwardly, vertically against the side of the brush block, as illustrated in FIG. 3, air can easily pass through slots 20, 21 and through slots 22, 23 to facilitate passage of air through the body for the purpose hereinafter appearing.

If the blower is held in such a way as to blow air horizontally sideways against the brush block air can still go through slot 20 and bore 14 through slot 22 and through slot 21 and bore 14 through slot 23. Air can also blow out of bore 14 through the end of said bore.

Between webs 25 and the bore are passage portions 30 interconnecting slots 20 and 21 and also interconnecting slots 22 and 23.

Between the sets of slots are completely circular brush block cylindrical portions 40. Between each adjacent set of slots eight equi-angularly spaced radial tufts 41 of brush bristles are embedded extending outwardly. The tufts are of equal lengths. There are 11 sets of tufts of brush bristles as shown in the drawing, there being one additional set beyond the end sets of slots. There are eight tufts 41 in each set of tufts, as shown on the drawing, although the number of tufts in each set may be varied.

The handle 12 is about same length as brush block 13. Said handle may have any attractive outer shape. Also it has an outer shape that facilitates grasping of the handle and rotation of the handle and movement of the brush. To this end said handle has a plurality of radially and longitudinally spaced, outwardly pointing projections or inserts 12*a* and troughs 12*b* between the projections. Such construction permits a firm grip on the handle and easy manipulation for styling the hair.

It will now be understood that the brush is especially designed for use with blow styling dryers. The slots are all inside the block and hot air actually flows through the brush making hair styling quicker and easier.

The brush block can be readily molded since a core can be placed in the mold for forming the bore 14, and removed by pulling it out after molding. Also mold parts can be moved down to form the slots 20, 22, to a horizontal plane through the axis of the brush block, and moved up to form the slots 21, 23, to a horizontal plane passing through the axis of the brush block. Such mold parts can be easily removed after molding.

It will be noted that the slots are large so that air can be readily blown sideways through the brush block. To this end, pairs of slots are diametrically aligned in different directions perpendicular to the axis of the brush block. Also the slots are of greater angular extent than the webs between the slots.

Webs 25 are shorter than webs 26, not only to enlarge the holes, but to permit use of molding die elements that can be moved in opposite directions, to allow the molded body of the brush to be removed from the mold.

The longitudinal distance of the openings in each set of openings is about half the longitudinal distance of the material between adjacent set of openings or slots. This arrangement makes the openings or slots large enough to allow air to pass through the diametric openings as the brush body is rotated.

It will be thus be seen that there is provided an article in which the several objects of this invention are achieved, and which is well adapted to meet the conditions of practical use.

As possible embodiments might be made of the above invention, and as various changes might be made in the embodiments above set forth, it is to be understood that all matter herein set forth or shown in the accompanying drawings, is to be interpreted as illustrative only.

I claim:

1. A hair brush intended to be used with a distinct and separate air blower which can be selectively moved relative to said hair brush, said hair brush comprising a body having an elongated handle, said handle having a first end and a second end, said ends being spaced apart from each other, an elongated tubular brush block affixed to said first end of said handle, said brush block being substantially in tandem with and coaxial of said handle so that said handle and said brush block may be rotated together about the elongated longitudinal axis of said handle and said brush block, said brush block being formed with an interior bore extending lengthwise of said brush block, said interior bore being coaxial with the longitudinal axis of said handle, said brush block being provided with inwardly directed web means defining a plurality of longitudinally and circumferentially spaced diametric elongated crossing through passages communicating at said bore arranged in transverse sets of passages to direct air initially toward said bore from a separate air blower from where the air can pass through said passages to be directed against a user's hair for the styling of said hair, each of said passages being in communication with said bore to allow air to be blown through said passages by the separate air blower toward one side of the brush block when juxtaposed adjacent said side thereof, a plurality of hair brush elements affixed to said brush block and projecting outwardly therefrom in longitudinally and circumferentially spaced relation and disposed between said sets of passages, said handle having means to close said handle to prevent air from being blown through said passages and said bore entirely through the handle of the brush block or through said handle to said bore and passages of said brush block.

2. A hair brush comprising a body having a handle, and an elongated tubular brush block rigidly fixed to one end of said handle, said brush block being substantially in tandem with and coaxial of said handle, so that said handle and brush block may be rotated together about the axis of said handle and brush block, said brush block being formed with an internal bore extending lengthwise of said brush block and being open at the outer end of the block, said brush block being provided with inwardly directed web means defining a plurality of longitudinally and circumferentially spaced transverse sets of elongated crossing diametric passages communicating with said bore to direct air initially directed toward a side of said brush block through said passages to allow air to be blown by a separate air blower toward one side of the brush block when juxtaposed with said side thereof, whereby blown air will pass through said passages directly to said bore of said brush block, and directly from said bore out of said passages to the other side of said brush block, a plurality of hair brush elements fixed to said brush block and projecting outwardly therefrom in longitudinally and circumferentially spaced relation and disposed between said sets of passages, and means to close the bore at the handle for preventing air from being transferred from the brush block interior into and through the handle but allowing air directed transversely toward said brush block to pass through said passages and to prevent air from passing through the handle to said brush block, said passages and bristles radiating circumferentially all around the brush block, said brush block having a circular exterior, said body comprising a single molded member.

3. The combination of claim 1, in which said passages are in the form of pairs of circumferentially spaced diametrically opposed slots, said inwardly directed web means comprising pairs of diametrically opposed webs between said pairs of opposed slots, said slots being aligned in rows on pairs of diametrically opposite sides of the brush block and communicating with the outside of the brush block thereby allowing air to pass transversely through the brush block, as the brush is rotated about its axis.

4. The combination of claim 3, said slots being arranged in longitudinally spaced sets of said slots, said webs being disposed between slots of said sets of slots.

5. The combination of claim 4, in which one or more of the webs between the slots of each set extends radially inwardly from the outer surface of the brush block to said bore, and one or more other of said webs between the slots of each set extends radially inwardly from the outer surface of said brush block but terminating short of said bore, so that the inner ends of the slots are enlarged thereby permitting air to readily pass radially through said slots.

6. The combination of claim 4, a pair of said webs between the slots of each set being in one plane and diametrically disposed one relative to the other, and another pair of said webs being diametrically disposed and in a plane crossing the first plane.

7. The combination of claim 1, said bore being open at the outer end of said brush block and closed at its end adjacent said handle.

8. The combination of claim 1, said handle having radially and longitudinally spaced projections and being formed with troughs between said projections.

9. The combination of claim 1, said handle being straight solid and said brush block being straight and extending from one end of said handle.

10. The combination of claim 9, said handle and brush block being aligned with each other.

11. The combination of claim 1, said brush block being cylindrical in shape.

12. The combination of claim 2, said body comprising molded plastic.

13. The combination of claim 1, said passages being in the form of circumferentially spaced slots said inwardly directed web means comprising webs between said slots, said slots being arranged in longitudinally spaced sets of said slots, one or more of the webs between the slots of each set extending radially inwardly from the outer surface of the brush block to said bore, and one or more other of said webs in each set extending radially inwardly from the outer surface of said block but terminating short of said bore, a pair of said webs between the slots of each set being in one plane and diametrically disposed one relative to the other, and another set of webs being diametrically disposed and in a plane crossing the first plane, and said bore being open at the outer end of said brush block.

14. The combination of claim 12, said handle having radially and longitudinally spaced projections and being formed with troughs between said projections.

15. The combination of claim 1, said handle being straight and said brush block being straight and extending from one end of said handle.

16. The combination of claim 1, said brush block being cylindrical in shape.

17. The combination of claim 6, in which the two planes are perpendicular to each other.

18. The combination of claim 13, in which the two planes are perpendicular to each other.

19. The combination of claim 1, each set of passages comprising pairs of diametrically opposed openings in different directions perpendicular to the axis of said brush block.

20. The combination of claim 1, said passages of each set of passages being of greater angular extent than the material between said passages, to thereby provide relatively large passages through which air blown against one side of the brush block may readily pass through the brush block transversely thereof as said brush is rotated about its axis.

21. The combination of claim 1, each set of passages comprising pairs of diametrically opposed openings in different directions perpendicular to the axis of said brush block, said passages of each set of openings being of greater angular extent than the material between said openings, to thereby provide relatively large openings through which air blown against one side of the brush block may readily pass through the brush block transversely thereof as said brush is rotated about its axis.

22. The combination of claim 1 wherein said bore is open at said second end of said brush block.

* * * * *